US007353800B2

(12) United States Patent
Gibson

(10) Patent No.: US 7,353,800 B2
(45) Date of Patent: Apr. 8, 2008

(54) MULTI-SOURCE FUEL SYSTEM HAVING GROUPED INJECTOR PRESSURE CONTROL

(75) Inventor: Dennis H. Gibson, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/420,057

(22) Filed: May 24, 2006

(65) Prior Publication Data

US 2007/0272204 A1 Nov. 29, 2007

(51) Int. Cl.
*F02M 43/00* (2006.01)

(52) U.S. Cl. ..... 123/304; 123/575

(58) Field of Classification Search ..... 123/304, 123/575, 576, 577, 578
See application file for complete search history.

(56) References Cited

U.S. PATENT DOCUMENTS

| | | | | |
|---|---|---|---|---|
| 3,000,319 | A | 9/1961 | Tuck | |
| 3,105,441 | A | 10/1963 | Grill et al. | |
| 4,083,345 | A | 4/1978 | Davis | |
| 5,094,216 | A | 3/1992 | Miyaki et al. | |
| 5,277,156 | A | 1/1994 | Osuka et al. | |
| 5,404,855 | A | 4/1995 | Yen et al. | |
| 5,433,182 | A | 7/1995 | Augustin et al. | |
| 5,441,027 | A | 8/1995 | Buchanon et al. | |
| 5,460,133 | A | 10/1995 | Perr et al. | |
| 5,592,968 | A | 1/1997 | Nakashima et al. | |
| 5,603,303 | A | 2/1997 | Okajima et al. | |
| 5,622,152 | A | 4/1997 | Ishida | |
| 5,642,714 | A * | 7/1997 | Buckley | 123/447 |
| 5,983,863 | A | 11/1999 | Cavanagh et al. | |
| 6,092,509 | A | 7/2000 | Tanabe et al. | |
| 6,095,118 | A | 8/2000 | Klinger et al. | |
| 6,112,721 | A * | 9/2000 | Kouketsu et al. | 123/447 |
| 6,253,735 | B1 | 7/2001 | Miyajima | |
| 6,311,674 | B1 | 11/2001 | Igashira et al. | |
| 6,357,421 | B1 | 3/2002 | Pritchard | |

(Continued)

FOREIGN PATENT DOCUMENTS

DE 199 39 422 A1 3/2001

(Continued)

OTHER PUBLICATIONS

B. Mahr (Robert Bosch GmbH, Diesel Systems, DS-NF/SBN, Postfach 30 02 20, D-70469 Stuttgart, Germany), "Future and Potential of Diesel Injection Systems", THIESEL 2002 Conference on Thermo- and Fluid-Dynamic Process In Diesel Engines, Sep. 2002, pp. 5-17, Valencia, Spain.

(Continued)

*Primary Examiner*—Erick Solis
(74) *Attorney, Agent, or Firm*—Finnegan, Henderson, Farabow, Garrett & Dunner

(57) ABSTRACT

A fuel system for an engine is disclosed. The fuel system has a first source of fuel at a first pressure, and a second source of fuel at a second pressure. The fuel system also has a first plurality of fuel injectors, and a first valve associated with the first plurality of fuel injectors. The first valve is configured to selectively direct fuel from the first source and fuel from the second source to only the first plurality of fuel injectors.

20 Claims, 3 Drawing Sheets

U.S. PATENT DOCUMENTS

| | | | | |
|---|---|---|---|---|
| 6,427,660 | B1 * | 8/2002 | Yang | 123/304 |
| 6,491,017 | B1 * | 12/2002 | Mahr et al. | 123/299 |
| 6,505,608 | B2 | 1/2003 | Hiraku et al. | |
| 6,619,263 | B1 | 9/2003 | Mahr et al. | |
| 6,684,855 | B2 | 2/2004 | Murakami et al. | |
| 6,832,599 | B2 | 12/2004 | Ibrahim et al. | |
| 6,889,656 | B1 | 5/2005 | Rembold et al. | |
| 6,899,084 | B2 | 5/2005 | Miyashita | |
| 6,973,921 | B2 | 12/2005 | Shafer et al. | |
| 7,146,963 | B2 * | 12/2006 | Tahara | 123/431 |
| 7,150,268 | B2 | 12/2006 | Shafer et al. | |
| 7,179,060 | B2 | 2/2007 | Sommars et al. | |
| 7,182,067 | B2 | 2/2007 | Ricco et al. | |
| 2004/0163626 | A1 | 8/2004 | Stockner et al. | |
| 2004/0168673 | A1 | 9/2004 | Shinogle | |
| 2005/0115544 | A1 | 6/2005 | Kim | |
| 2005/0126545 | A1 | 6/2005 | Shafer et al. | |
| 2007/0101968 | A1 | 5/2007 | Gibson et al. | |

FOREIGN PATENT DOCUMENTS

| | | | |
|---|---|---|---|
| DE | 199 45 673 | A1 | 5/2001 |
| EP | 0 643 221 | B1 | 4/1998 |
| EP | 1 273 797 | A2 | 1/2003 |
| EP | 1389680 | A2 | 2/2004 |
| EP | 1 522 719 | A1 | 4/2005 |
| JP | 6-93936 | | 5/1994 |
| WO | WO 01/24320 | A1 | 4/2001 |
| WO | WO 2007/055805 | | 5/2007 |

OTHER PUBLICATIONS

Research Disclosure, Nov. 2004, No. 487, www.researchdisclosure.com, Kenneth Mason Publications Ltd.; Westbourne, Hampshire, UK.

PCT International Search Report for PCT/US2006/036727 mailed Jan. 22, 2007.

PCT International Search Report for PCT/US2007/012029 mailed Dec. 7, 2007.

* cited by examiner

MULTI-SOURCE FUEL SYSTEM HAVING GROUPED INJECTOR PRESSURE CONTROL

TECHNICAL FIELD

The present disclosure is directed to a fuel system and, more particularly, to a fuel system having multiple sources of pressurized fuel and groups of injectors with common pressure control.

BACKGROUND

Common rail fuel systems provide a way to introduce fuel into the combustion chambers of an engine. Typical common rail fuel systems include an injector having an actuating solenoid that opens a fuel nozzle when the solenoid is energized. Fuel is then injected into the combustion chamber as a function of the time period during which the solenoid remains energized and the pressure of fuel supplied to the fuel injector nozzle during that time period.

To optimize engine performance and exhaust emissions, engine manufacturers may vary the pressure of the fuel supplied to the fuel injector nozzle. One such example is described in U.S. Patent Application Publication No. 2004/0168673 (the '673 publication) by Shinogle published Sep. 2, 2004. The '673 publication describes a fuel system having a plurality of fuel injectors fluidly connectable to a first common rail holding a supply of fuel, and a second common rail holding a supply of actuation fluid. Each fuel injector of the '673 publication is equipped with an intensifier piston movable by the actuation fluid to increase the pressure of the fuel. By fluidly connecting a fuel injector to the first common rail, fuel can be sprayed from the injector at a first pressure. By fluidly connecting the injector to the first and second common rails, fuel can be sprayed from the injector at a second pressure that is higher than the first pressure.

Although the fuel injection system of the '673 publication may include multiple supplies of pressurized fluid that cooperate to adequately supply fuel to an engine at different pressures, it may, however, be complex and expensive. Specifically, because each fuel injector includes its own dedicated intensifier to vary the pressure of the fuel sprayed from that injector, the system may include a large number of components. This large number of components may increase the cost of the fuel injection system and the difficulty in precisely controlling the fuel system.

The fuel system of the present disclosure solves one or more of the problems set forth above.

SUMMARY OF THE INVENTION

One aspect of the present disclosure is directed to a fuel system for an engine. The fuel system includes a first source of fuel at a first pressure, and a second source of fuel at a second pressure. The fuel system also includes a first plurality of fuel injectors, and a first valve associated with the first plurality of fuel injectors. The first valve is configured to selectively direct fuel from the first source and fuel from the second source to only the first plurality of fuel injectors.

Another aspect of the present disclosure is directed to a method of injecting fuel. The method includes pressurizing fuel to a first pressure, and pressurizing fuel to a second pressure. The method also includes directing fuel at the first pressure and fuel at the second pressure to a first plurality of injectors, and directing fuel at the first pressure and fuel at the second pressure to a second plurality of injectors. The method further includes selectively regulating the pressure of the fuel directed to the first plurality of injectors, and selectively regulating the pressure of the fuel directed to the second plurality of injectors separate from the regulated fuel directed to the first plurality of injectors.

DETAILED DESCRIPTION

Figure 1:
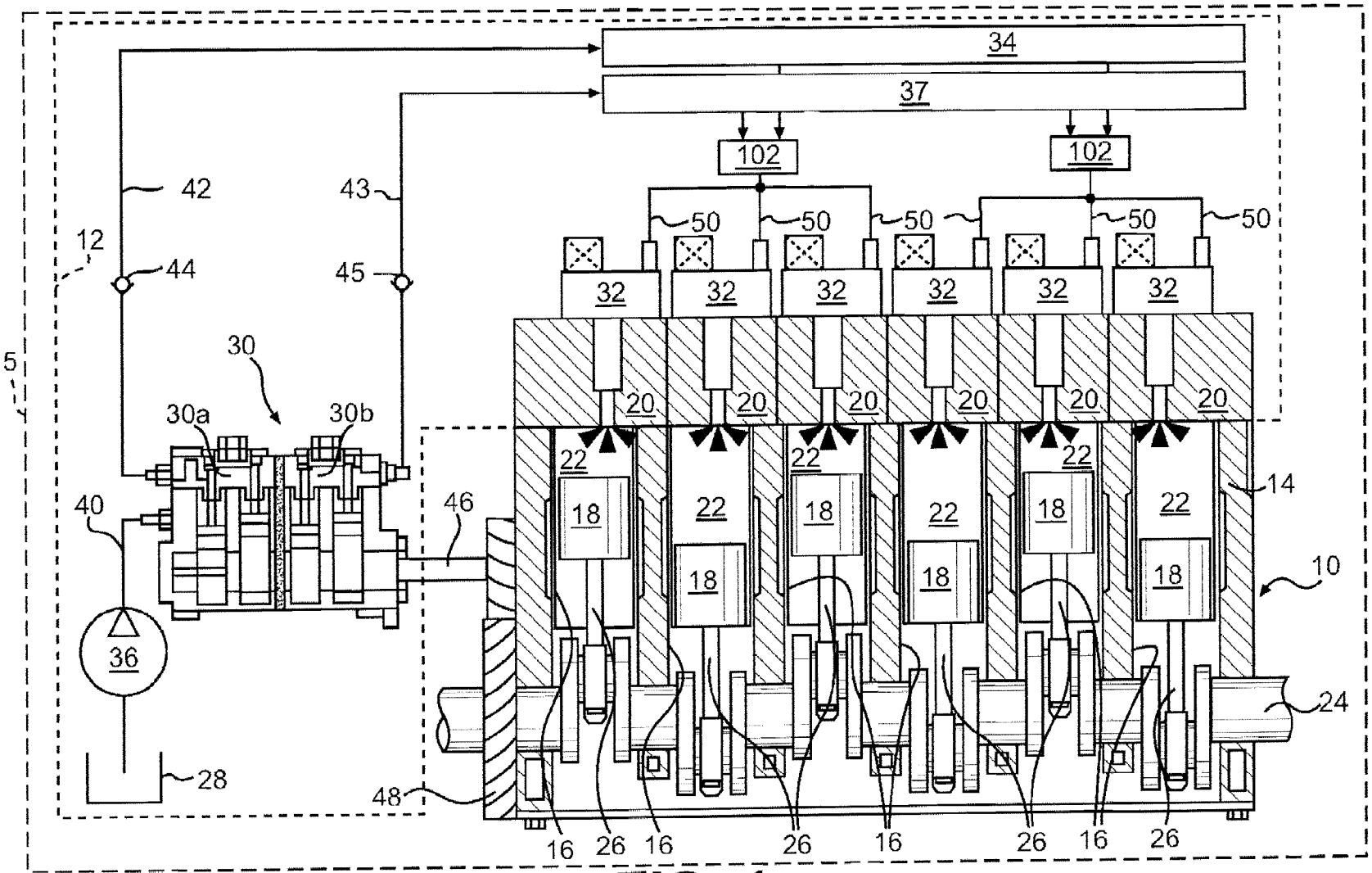
FIG. 1 is a schematic and diagrammatic illustration of an exemplary disclosed engine.

FIG. 1 illustrates a machine 5 having an engine 10 and an exemplary embodiment of a fuel system 12. Machine 5 may be a fixed or mobile machine that performs some type of operation associated with an industry such as mining, construction, farming, power generation, transportation, or any other industry known in the art. For example, machine 5 may embody an earth moving machine, a generator set, a pump, or any other suitable operation-performing machine.

For the purposes of this disclosure, engine 10 is depicted and described as a four-stroke diesel engine. One skilled in the art will recognize, however, that engine 10 may embody any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, a crankshaft 24 may be rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18. As crankshaft 24 rotates, combustion chambers 22 may fire in a specific order. The firing order, when numbering combustion chambers 22 from the left of FIG. 1, may be, for example, 1, 5, 3, 6, 2, 4. That is, the first or left-most combustion chamber, may fire first (e.g., combustion a mixture of fuel and air before the remaining cylinders within a single 360 degree revolution of crankshaft 24). Following the firing of the left-most combustion chamber 22, the fifth combustion chamber from the left may fire, and so on. In this manner, no adjacent combustion chambers 22 may fire consecutively.

Fuel system 12 may include components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct one or more flows of pressurized fuel to a plurality of fuel injectors 32. A fuel transfer pump 36 may be disposed within a fuel line 40 between tank 28 and fuel pumping arrangement 30 to provide low pressure feed to fuel pumping arrangement 30.

Fuel pumping arrangement 30 may embody a mechanically driven, electronically controlled pump having a first pumping mechanism 30*a* and a second pumping mechanism 30*b*. Each of first and second pumping mechanisms 30*a, b* may be operatively connected to a pump drive shaft 46 by way of rotatable cams (not shown). The cams may be adapted to drive piston elements (not shown) of first and second pumping mechanisms 30*a, b* through a compression stroke to pressurize fuel. Plungers (not shown) associated with first and second pumping mechanisms 30*a, b* may be closed at variable timings to change the length of the compression stroke and thereby vary the flow rate of first and second pumping mechanisms 30*a, b*. Alternatively, first and second pumping mechanisms 30*a, b* may include a rotatable swashplate, or any other means known in the art for varying the flow rate of pressurized fuel.

First and second pumping mechanisms 30*a, b* may be adapted to generate separate flows of pressurized fuel. For example, first pumping mechanism 30*a* may generate a first flow of pressurized fuel directed to a first common rail 34 by way of a first fuel supply line 42. Second pumping mechanism 30*b* may generate a second flow of pressurized fuel directed to a second common rail 37 by way of a second fuel supply line 43. In one example, the first flow of pressurized fuel may have a pressure of about 100 MPa, while the second flow of pressurized fuel may have a pressure of about 200 MPa. A first check valve 44 may be disposed within first fuel supply line 42 to provide unidirectional flow of fuel from first pumping mechanism 30*a* to first common rail 34. A second check valve 45 may be disposed within second fuel supply line 43 to provide unidirectional flow of fuel from second pumping mechanism 30*b* to second common rail 37.

Fuel pumping arrangement 30 may be operatively connected to engine 10 and driven by crankshaft 24. For example, pump driveshaft 46 of fuel pumping arrangement 30 is shown in FIG. 1 as being connected to crankshaft 24 through a gear train 48. It is contemplated, however, that one or both of first and second pumping mechanisms 30*a, b* may alternatively be driven electrically, hydraulically, pneumatically, or in any other appropriate manner.

Fuel injectors 32 may be disposed within cylinder heads 20 and connected to first and second common rails 34, 37 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center (TDC) position in a compression stroke to allow for compression-ignited-combustion of the injected fuel. Alternatively, fuel may be injected as piston 18 begins the compression stroke heading towards the TDC position for homogenous charge compression ignition operation. Fuel may also be injected as piston 18 is moving from the TDC position towards a bottom-dead-center (BDC) position during an expansion stroke for a late post injection to create a reducing atmosphere for aftertreatment regeneration.

Figure 2:
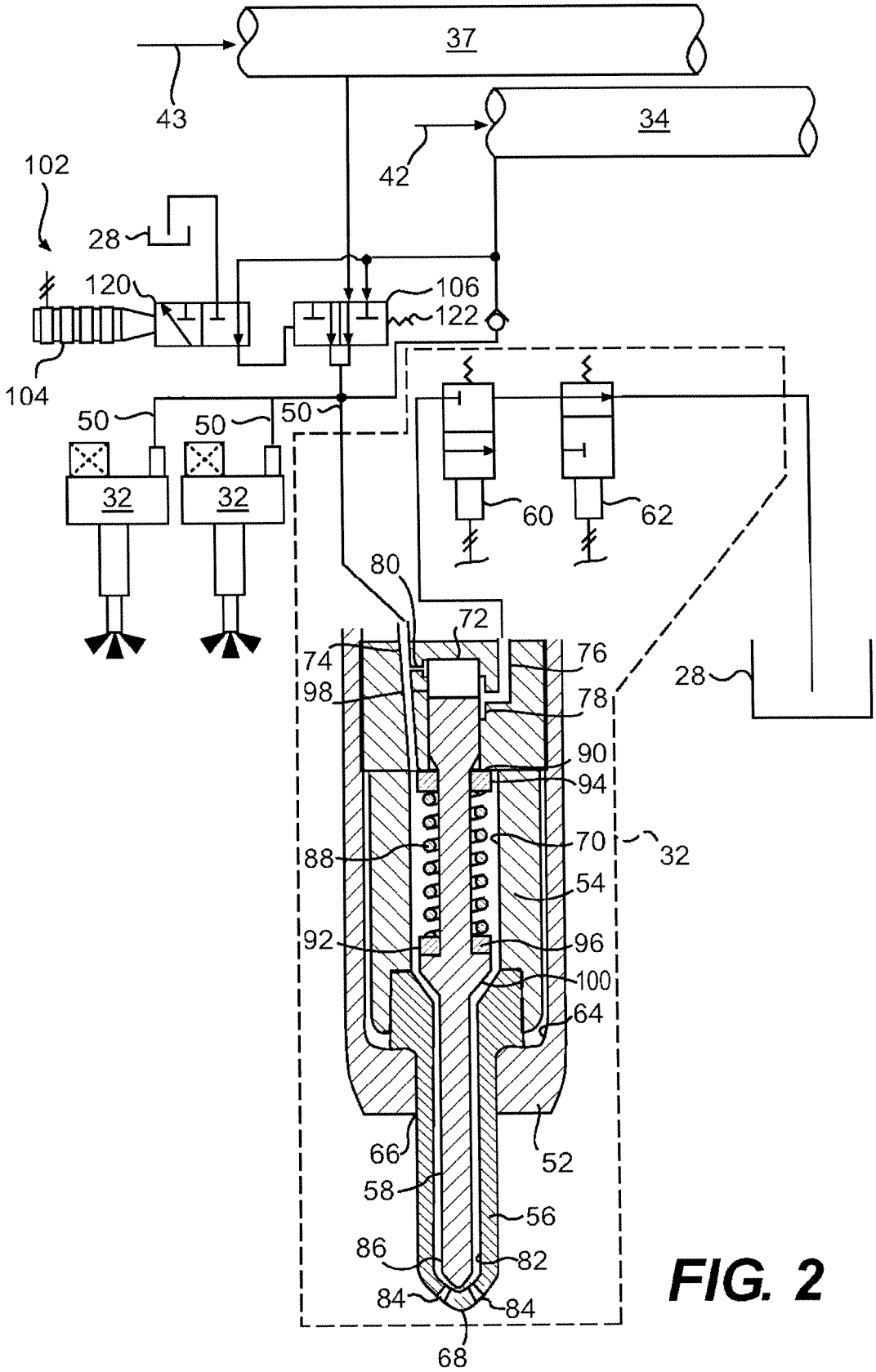
FIG. 2 is a schematic and cross-sectional illustration of an exemplary disclosed fuel system for the engine of FIG. 1.

As illustrated in FIG. 2, each fuel injector 32 may embody a closed nozzle unit fuel injector. Specifically, each fuel injector 32 may include an injector body 52 housing a guide 54, a nozzle member 56, a needle valve element 58, a first solenoid actuator 60, and a second solenoid actuator 62.

Injector body 52 may be a generally cylindrical member configured for assembly within cylinder head 20. Injector body 52 may have a central bore 64 for receiving guide 54 and nozzle member 56, and an opening 66 through which a tip end 68 of nozzle member 56 may protrude. A sealing member such as, for example, an o-ring (not shown) may be disposed between guide 54 and nozzle member 56 to restrict fuel leakage from fuel injector 32.

Guide 54 may also be a generally cylindrical member having a central bore 70 configured to receive needle valve element 58, and a control chamber 72. Central bore 70 may act as a pressure chamber, holding pressurized fuel continuously supplied by way of a fuel supply passageway 74. During injection, the pressurized fuel from fuel line 50 may flow through fuel supply passageway 74 and central bore 70 to the tip end 68 of nozzle member 56.

Control chamber 72 may be selectively drained of or supplied with pressurized fuel to control motion of needle valve element 58. Specifically, a control passageway 76 may fluidly connect a port 78 associated with control chamber 72, and first solenoid actuator 60. Port 78 may be disposed within a side wall of control chamber 72 that is radially oriented relative to axial movement of needle valve element 58 or, alternatively, within an axial end portion of control chamber 72. Control chamber 72 may be continuously supplied with pressurized fuel via a restricted supply passageway 80 that is in communication with fuel supply passageway 74. The restriction of supply passageway 80 may allow for a pressure drop within control chamber 72 when control passageway 76 is drained of pressurized fuel.

Nozzle member 56 may likewise embody a generally cylindrical member having a central bore 82 that is configured to receive needle valve element 58. Nozzle member 56 may further include one or more orifices 84 to allow injection of the pressurized fuel from central bore 82 into combustion chambers 22 of engine 10.

Needle valve element 58 may be a generally elongated cylindrical member that is slidingly disposed within housing guide 54 and nozzle member 56. Needle valve element 58 may be axially movable between a first position at which a tip end 86 of needle valve element 58 blocks a flow of fuel through orifices 84, and a second position at which orifices 84 are open to allow a flow of pressurized fuel into combustion chamber 22.

Needle valve element 58 may be normally biased toward the first position. In particular, each fuel injector 32 may include a spring 88 disposed between a stop 90 of guide 54 and a seating surface 92 of needle valve element 58 to axially bias tip end 86 toward the orifice-blocking position. A first spacer 94 may be disposed between spring 88 and stop 90, and a second spacer 96 may be disposed between spring 88 and seating surface 92 to reduce wear of the components within fuel injector 32.

Needle valve element 58 may have multiple driving hydraulic surfaces. In particular, needle valve element 58 may include a hydraulic surface 98 tending to drive needle valve element 58 toward the first or orifice-blocking position when acted upon by pressurized fuel, and a hydraulic surface 100 that tends to oppose the bias of spring 88 and drive needle valve element 58 in the opposite direction toward the second or orifice-opening position.

First solenoid actuator 60 may be disposed opposite tip end 86 of needle valve element 58 to control the opening motion of needle valve element 58. In particular, first solenoid actuator 60 may include a two-position valve element disposed between control chamber 72 and tank 28. The valve element may be spring-biased toward a closed position blocking fluid flow from control chamber 72 to tank 28, and solenoid-actuated toward an open position at which fuel is allowed to flow from control chamber 72 to tank 28. The valve element may be movable between the closed and open positions in response to an electric current applied to a coil associated with first solenoid actuator 60. It is contemplated that the valve element may alternatively be hydraulically operated, mechanically operated, pneumatically operated, or operated in any other suitable manner. It is further contemplated that the valve element may alternatively embody a proportional type of valve element that is movable to any position between the closed and open positions.

Second solenoid actuator 62 may include a two-position valve element disposed between first solenoid actuator 60 and tank 28 to control a closing motion of needle valve element 58. The valve element may be spring-biased toward an open position at which fuel is allowed to flow to tank 28, and solenoid-actuated toward a closed position blocking fluid flow to tank 28. The valve element may be movable between the open and closed positions in response to an electric current applied to a coil associated with second solenoid actuator 62. It is contemplated that the valve element may alternatively be hydraulically operated, mechanically operated, pneumatically operated, or operated in any other suitable manner. It is further contemplated that the valve element may alternatively embody a three-position type of valve element, wherein bidirectional flows of pressurized fuel are facilitated.

As also illustrated in FIG. 2, one or more pressure control devices 102 may be associated with fuel injectors 32. Specifically, a first pressure control devices 102 may be associated with a first group of fuel injectors 32, while a second pressure control device 102 may be associated with a second group of fuel injectors 32. Each of the first and second groups of fuel injectors 32 may be associated with only non-consecutively firing combustion chambers 22. For example, those fuel injectors 32 associated with combustion chambers 22 numbered 1, 2, and 3 may be in the first group of fuel injectors 32, while those fuel injectors 32 associated with combustion chambers 22 numbered 4, 5, and 6 may be in the second group. In this manner, the fuel injectors 32 within a single group may never inject fuel consecutively.

By limiting consecutive injections of fuel from a group of commonly pressure regulated fuel injectors 32, adequate time may be provided for pressure control device 102 to respond to varying pressure requirements between injection events. That is, by alternating injection events between the groups of fuel injectors 32, twice as much time is afforded pressure control device 102 for responding to a required injection pressure, as compared to consecutive injections from within the same group of fuel injectors 32. In this manner, each pressure control device 102 must only respond fast enough to regulate the pressure of every other injection event.

Each pressure control device 102 may include an actuator 104 operatively connected to a valve element 106. Valve element 106 may be movable by actuator 104 to selectively combine the first and second flows of pressurized fuel and direct the combined flow to the corresponding first or second groups of fuel injectors 32.

Actuator 104 may embody a piezo electric device having one or more columns of piezo electric crystals. Piezo electric crystals are structures with random domain orientations. These random orientations are asymmetric arrangements of positive and negative ions that exhibit permanent dipole behavior. When an electric field is applied to the crystals, such as, for example, by the application of a current, the piezo electric crystals expand along the axis of the electric field as the domains line up.

Actuator 104 may be connected to move valve element 106 by way of pilot fluid. In particular, a pilot element 120 connected to actuator 104 may be movable between a first position at which pilot fluid from common rail 34 is communicated with an end of valve element 106, and a second position at which the pilot fluid from the end of valve element 106 is allowed to drain to tank 28. As current is applied to the piezo electric crystals of actuator 104, actuator 104 may expand to move pilot element 120 from the first position toward the second position. In contrast, as the current is removed from the piezo electric crystals of actuator 104, actuator 104 may contract to return pilot element 120 toward the first position. It is contemplated that the piezo electric crystals of actuator 104 may be omitted, if desired, and the movement of pilot element 120 be controlled in another suitable manner. It is further contemplated that actuator 104 may alternatively be directly and mechanically connected to move valve element 106 without the use of pilot element 120, if desired.

Valve element 106 may embody a proportional valve element or other suitable device movable in response to the pilot fluid described above. Specifically, when sufficient pilot fluid from common rail 34 is in contact with the end of valve element 106, valve element 106 may be in or urged toward a first position, at which only the first flow of pressurized fuel is directed to the corresponding group of fuel injectors 32. As the pilot fluid is drained away from the end of valve element 106, a spring 122 may bias valve element 120 toward a second position, at which only the second flow of pressurized fuel is directed to the corresponding fuel injector group. Valve element 106 may be movable by way of the pilot fluid to any position between the first and second positions to direct a portion of the first and second pressurized flows of fuel to the fuel injector group. The amount and ratio of the first or second flows directed by valve element 106 may depend on the current applied to the piezo electric crystals of actuator 104 and may affect the resultant pressure of the supplied fuel. In addition, the speed of the fluid flowing through pilot element 120 may affect the actuation speed of valve element 120 and the resulting rate at which the injection pressure changes. This modulating/combining of pressurized fuel may allow for a variable pressure of fuel with central bores 82, resulting in a variable injection rate of fuel through orifices 84 and penetration depth into combustion chambers 22.

Figure 3:
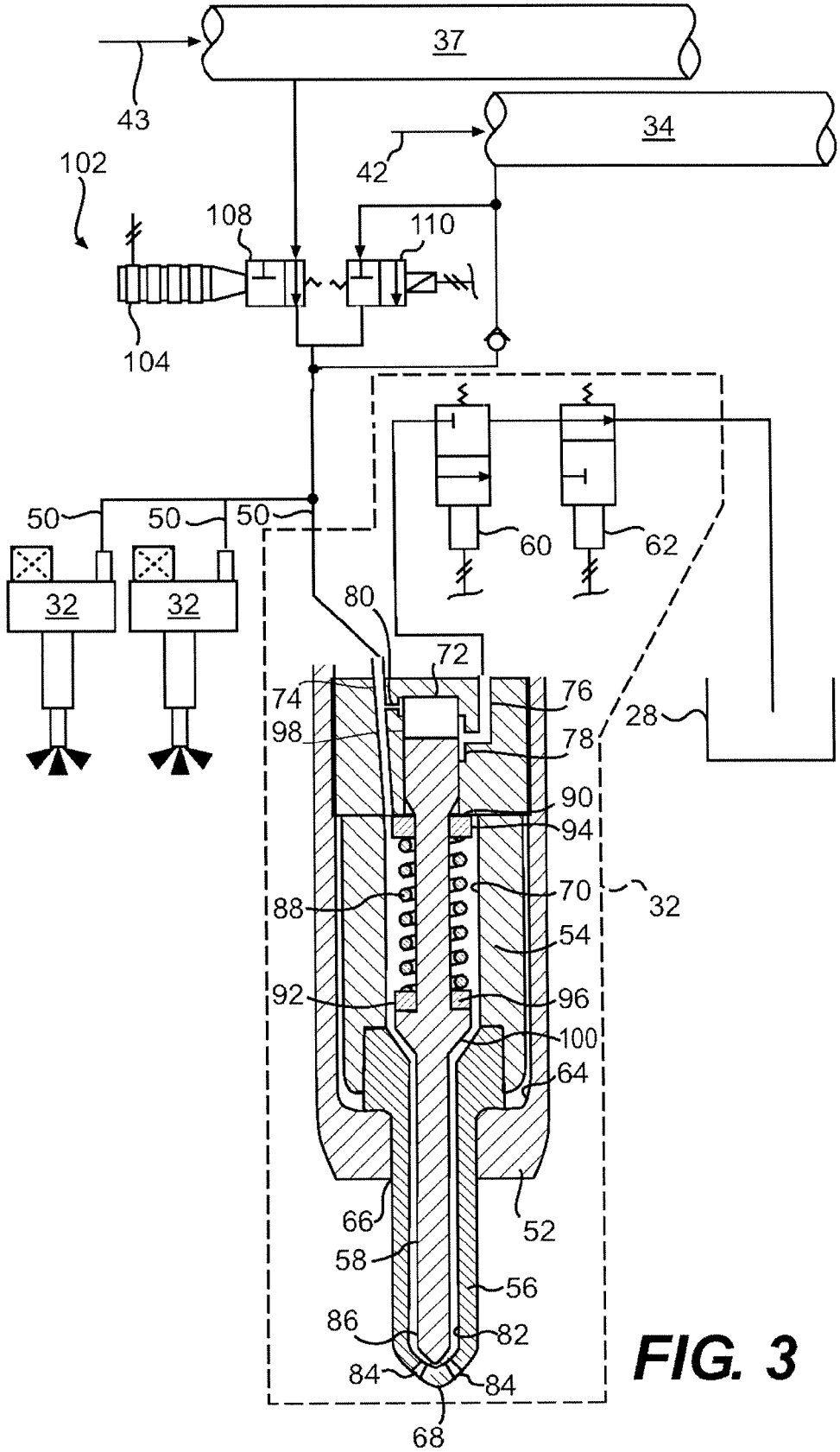
FIG. 3 is a schematic and cross-sectional illustration of another exemplary disclosed fuel system for the engine of FIG. 1.

FIG. 3 illustrates an alternative embodiment to fuel system 12 of FIG. 2. Similar to fuel system 12 of FIG. 2, fuel system 12 of FIG. 3 may include two groups of fuel injectors 32 receiving flows of pressurized fuel from first and second common rails 34 and 37 via fuel line 50 and two pressure control devices 102. However, in contrast to the single valve element 106 associated with each actuator 104 depicted in FIG. 2, each actuator 104 of FIG. 3 may include two separate valve elements 108 and 110.

During an injection event when the first and second flows of pressurized fuel are directed through valve element 106 (referring to FIG. 2), it is possible for the higher pressure fuel from first common rail 37 to flow in reverse direction into second common rail 34. This reverse flow can reduce the efficiency of fuel system 12. To improve the efficiency of fuel system 12, actuator 104 of FIG. 3 may implement separate valve elements 108 and 110.

Similar to valve element 106, valve element 108 may embody a proportional valve element or other suitable device movable by actuator 104. Although illustrated in this embodiment as actuator 104 being directly and mechanically coupled to valve element 108, it is contemplated that actuator 104 may alternatively be indirectly connected to valve element 108 by way of a pilot element (not shown) similar to pilot element 120 of FIG. 2. Valve element 108 may be movable between a first position at which pressurized fuel from second common rail 37 is blocked from the corresponding group of fuel injectors 32, and a second position at which a maximum amount of fuel from second common rail 37 is directed to the group of fuel injectors 32. Valve element 108 may also be movable to any position between the first and second positions to direct a portion of the second pressurized flow of fuel to the fuel injector group. The amount of the second flow of pressurized fuel from second common rail 37 directed by valve element 108 to the group of fuel injectors 32 may correspond to the current applied to the piezo electric crystals of actuator 104.

In contrast to valve element 108, valve element 110 may embody a two-position, solenoid-actuated valve element. Valve element 110 may be movable from a first position at which substantially no pressurized fuel from first common rail 34 is directed to the corresponding fuel injector group, to a second position at which a maximum amount of fuel from the first common rail 34 is directed to the group of fuel injectors 32. Valve elements 108 and 110 may be separately or simultaneously operated to independently direct pressurized fuel from either the first common rail 34, the second common rail 37, or both of the first and second common rails 34, 37. This combining of pressurized fuel from first and second common rails 34, 37 may allow for a variable pressure of fuel with the central bores 82 of the corresponding fuel injector group, resulting in a variable injection rate of fuel through orifices 84 and penetration depth into combustion chamber 22.

INDUSTRIAL APPLICABILITY

The fuel system of the present disclosure has wide application in a variety of engine types including, for example, diesel engines, gasoline engines, and gaseous fuel-powered engines. The disclosed fuel system may be implemented into any engine that utilizes a pressurizing fuel system wherein it may be advantageous to provide a common variable pressure supply of fuel to different groups of injectors. The operation of fuel system 12 will now be explained.

Needle valve element 58 may be moved by an imbalance of force generated by fuel pressure. For example, when needle valve element 58 is in the first or orifice-blocking position, pressurized fuel from fuel supply passageway 74 may flow into control chamber 72 to act on hydraulic surface 98. Simultaneously, pressurized fuel from fuel supply passageway 74 may flow into central bores 70 and 82 in anticipation of injection. The force of spring 88 combined with the hydraulic force generated at hydraulic surface 98 may be greater than an opposing force generated at hydraulic surface 100 thereby causing needle valve element 58 to remain in the first position to restrict fuel flow through orifices 84. To open orifices 84 and inject the pressurized fuel from central bore 82 into combustion chamber 22, first solenoid actuator 60 may move its associated valve element to selectively drain the pressurized fuel away from control chamber 72 and hydraulic surface 98. This decrease in pressure acting on hydraulic surface 98 may allow the opposing force acting across hydraulic surface 100 to overcome the biasing force of spring 88, thereby moving needle valve element 58 toward the orifice-opening position.

To close orifices 84 and end the injection of fuel into combustion chamber 22, second solenoid actuator 62 may be energized. In particular, as the valve element associated with second solenoid actuator 62 is urged toward the flow blocking position, fluid from control chamber 72 may be prevented from draining to tank 28. Because pressurized fluid is continuously supplied to control chamber 72 via restricted supply passageway 80, pressure may rapidly build within control chamber 72 when drainage through control passageway 76 is prevented. The increasing pressure within control chamber 72, combined with the biasing force of spring 88, may overcome the opposing force acting on hydraulic surface 100 to force needle valve element 58 toward the closed position. It is contemplated that second solenoid actuator 62 may be omitted, if desired, and first solenoid actuator 60 used to initiate both the opening and closing motions of needle valve element 58.

Each pressure control device 102 may affect pressure of the fuel supplied to a corresponding group of fuel injectors 32 in response to the pressure required by only the actuated one of the fuel injectors 32 within the group. Specifically, in response to a current applied to the piezo electric crystals of actuator 104, actuator 104 may affect movement of valve elements 106 (referring to FIG. 2) and 108 (referring to FIG. 3) to increase or decrease the amount of pressurized fuel flowing from second common rail 37 to the group of fuel injectors 32 for use by the fuel injector 32 being actuated. With regard to the embodiment of FIG. 2, the movement of actuator 104 may also simultaneously control the amount of pressurized fuel flowing from first common rail 34 into the corresponding group of fuel injectors 32. In contrast, with regard to the embodiment of FIG. 3, valve element 110 may be independently controlled to allow or block the flow of fuel from first common rail 34 to the group of fuel injectors 32.

This change in the flow rates of fuel from first and second common rails 34, 37 may directly and immediately affect the pressure of fuel within central bores 70 and 82. For example, an increased current applied to actuator 104 may cause a decrease in the flow rate of pressurized fuel from second common rail 37 and a resulting lower pressure of fuel directed to a common group of fuel injectors 32. In contrast, a decreased current applied to actuator 104 may cause an increase in the flow rate of pressurized fuel from second common rail 37 and a resulting higher pressure of fuel directed to the common group of fuel injectors 32. With regard to FIG. 2, the changes in flow rate of pressurized fuel from second common rail 37 may simultaneously correspond to an inverse change in flow rate of pressurized fuel from first common rail 34. With regard to FIG. 3, the flow rate of pressurized fuel from first common rail 34 may be independently controlled via solenoid-actuated valve element 110.

Because fuel system 12 may utilize common pressure control devices 102, the complexity and cost of fuel system 12 may be low. Specifically, because one pressure control device 102 may be utilized to control the injection pressure of multiple fuel injectors 32, the number of components of fuel system 12 may low, resulting a simple, inexpensive system. Further, because each pressure control device is associated with only non-consecutively firing combustion chambers, the responsiveness of pressure control devices 102 may be sufficient for a wide variety of applications.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the invention being indicated by the following claims and their equivalents.

What is claimed is:

1. A fuel system for an engine, comprising:

a first source of fuel at a first pressure;

a second source of fuel at a second pressure;

a first plurality of fuel injectors; and a first valve associated with the first plurality of fuel injectors and configured to selectively direct fuel from the first source and fuel from the second source to only the first plurality of fuel injectors.

2. The fuel system of claim 1, further comprising:

a second plurality of fuel injectors; and a second valve associated with the second plurality of fuel injectors and configured to selectively direct fuel from the first source and fuel from the second source to only the second plurality of fuel injectors.

3. The fuel system of claim 2, wherein the first and second valves are configured to selectively combine fuel from the first source and fuel from the second source to create a flow of fuel at a third pressure.

4. The fuel system of claim 2, wherein:

the first plurality of fuel injectors is associated with only non-consecutively firing combustion chambers of the engine; and the second plurality of fuel injectors is associated with only non-consecutively firing combustion chambers of the engine.

5. The fuel system of claim 2, wherein the pressure of the fuel supplied at a give time to all of the first plurality of injectors is at a pressure desired for injection by only one of the first plurality of injectors.

6. The fuel system of claim 2, wherein the pressure of the fuel directed by the first and second valves may vary during a single injection event.

7. The fuel system of claim 2, wherein at least one of the first and second valves includes a main valve element movable between a first position at which fuel from only the first source is directed through the at least one of the first and second valves, and a second position at which fuel from only the second source is directed through the at least one of the first and second valves.

8. The fuel system of claim 7, wherein:

the at least one of the first and second valves further includes a pilot valve element and a piezo device; and the piezo device is configured to move the pilot valve element between a first position at which pilot fluid is selectively communicated with an end of the main valve element, and a second position at which the pilot fluid is drained from the end of the main valve element.

9. The fuel system of claim 2, further including:

a first valve element associated with the first source of pressurized fuel and being movable from a first position at which fuel from the first source is communicated with the first plurality of fuel injectors, to a second position at which fuel from the first source is blocked from the first plurality of fuel injectors; and a second valve element associated with the second source of pressurized fuel and being movable between a first position at which fuel from the second source is communicated with the first plurality of fuel injectors, and a second position at which fuel from the second source is blocked from the first plurality of fuel injectors, wherein the control is configured to move the second valve element to a position between the first and second positions based on the desired injection pressure.

10. A method of injecting fuel, comprising:

pressuring fuel to a first pressure;

pressurizing fuel to a second pressure;

directing fuel at the first pressure and fuel at the second pressure to a first plurality of injectors;

directing fuel at the first pressure and fuel at the second pressure to a second plurality of injectors;

selectively regulating the pressure of the fuel directed to the first plurality of injectors; and selectively regulating the pressure of the fuel directed to the second plurality of injectors separate from the regulated fuel directed to the first plurality of injectors.

11. The method of claim 10, wherein selectively regulating includes combining fuel at the first pressure and fuel at the second pressure to produce a flow of fuel at a third pressure.

12. The method of claim 11, further including varying the pressure of the combined fuel flow during an injection event.

13. The method of claim 11, wherein regulating includes selectively passing only fuel at the first pressure and only fuel at the second pressure to at least one of the first and second pluralities of injectors.

14. The method of claim 10, further including always alternatingly actuating one of the first plurality of injectors and one of the second plurality of injectors to inject fuel during operation of an associated engine.

15. A machine, comprising:

an engine having a first plurality of non-consecutively firing combustion chambers and a second plurality of non-consecutively firing combustion chambers;

a first source of fuel at a first pressure;

a second source of fuel at a second pressure;

a first plurality of fuel injectors configured to inject fuel into the first plurality of combustion chambers;

a second plurality of fuel injectors configured to inject fuel into the second plurality of combustion chambers;

a first valve associated with the first plurality of fuel injectors and configured to selectively combine and direct fuel from the first source and fuel from the second source to the first plurality of fuel injectors; and a second valve associated with the second plurality of fuel injectors and configured to selectively combine and direct fuel from the first source and fuel from the second source to the second plurality of fuel injectors.

16. The machine of claim 15, wherein the pressure of the fuel supplied at a give time to all of the first plurality of injectors is at a pressure desired for injection by only one of the first plurality of injectors.

17. The machine of claim 15, wherein the pressure of the fuel directed by the first and second valves may vary during a single injection event.

18. The machine of claim 15, wherein at least one of the first and second valves includes a main valve element movable between a first position at which fuel from only the first source is directed through the at least one of the first and second valves, and a second position at which fuel from only the second source is directed through the at least one of the first and second valves.

19. The machine of claim 18, wherein:

the at least one of the first and second valves further includes a pilot valve element and a piezo device; and the piezo device is configured to move the pilot valve element between a first position at which pilot fluid is selectively communicated with an end of the main valve element, and a second position at which the pilot fluid is drained from the end of the main valve element.

20. The machine of claim 15, further including:

a first valve element associated with the first source of pressurized fuel and being movable from a first position at which fuel from the first source is communicated with the first plurality of fuel injectors, to a second position at which fuel from the first source is blocked from the first plurality of fuel injectors; and a second valve element associated with the second source of pressurized fuel and being movable between a first position at which fuel from the second source is communicated with the first plurality of fuel injectors, and a second position at which fuel from the second source is blocked from the first plurality of fuel injectors, wherein the control is configured to move the second valve element to a position between the first and second positions based on the desired injection pressure.

* * * * *